US005361933A

United States Patent [19]

Oster

[11] Patent Number: 5,361,933

[45] Date of Patent: Nov. 8, 1994

[54] ICE CREAM STORAGE SHIELD

[76] Inventor: Peter R. Oster, P.O. Box 188, St. Anthony's Dr., Drifton, Pa. 18221

[21] Appl. No.: 136,756

[22] Filed: Oct. 15, 1993

[51] Int. Cl.[5] ..... B65D 81/24

[52] U.S. Cl. ..... 220/578; 220/212.5; 220/216; 220/377; 426/111; 426/393

[58] Field of Search ..... 220/212.5, 216, 377, 220/578; 426/111, 392, 393, 444

[56] References Cited

U.S. PATENT DOCUMENTS

| | | | |
|---|---|---|---|
| Re. 10,643 | 9/1885 | Elder | 220/216 X |
| 1,092,902 | 4/1914 | Doggett | 220/578 |
| 1,145,915 | 7/1915 | Marcuse . | |
| 2,190,203 | 2/1940 | Barnard | 220/578 |
| 2,472,404 | 6/1949 | Cadwell | 220/212.5 |
| 2,556,195 | 6/1951 | Kors | 220/578 |
| 3,164,289 | 1/1965 | Cocchiarella | 220/578 |
| 3,237,552 | 3/1966 | Cronheim | 220/212.5 X |
| 3,784,051 | 1/1974 | Shaw et al. . | |
| 4,413,747 | 11/1983 | Tenold et al. . | |
| 4,684,042 | 8/1987 | Strickler et al. . | |
| 4,723,674 | 2/1988 | Nunes . | |
| 4,907,719 | 3/1990 | Spotholz et al. | 220/216 X |
| 4,938,377 | 7/1990 | Jarvis | 220/216 |
| 5,004,118 | 4/1991 | England et al. | 220/216 |
| 5,213,230 | 5/1993 | Kral . | |
| 5,232,112 | 8/1993 | Howard | 220/212.5 |

FOREIGN PATENT DOCUMENTS

| | | | |
|---|---|---|---|
| 475459 | 8/1969 | Switzerland | 220/216 |

*Primary Examiner*—Allan N. Shoap
*Assistant Examiner*—Stephen Cronin
*Attorney, Agent, or Firm*—Richard C. Litman

[57] ABSTRACT

A storage shield provides a removable cover for placement on the surface of frozen ice cream remaining in an opened container, thereby partially sealing the surface of the ice cream from the air-filled voids. The shield, in one embodiment of the invention, is especially adapted for use in a conventional one-half gallon size, box-shaped ice cream carton. The shield is made from a transparent synthetic resin material, thus making it possible for the user to see any remaining air pockets through the shield. The shield, in this embodiment, is a rectangular-shaped planar device with smooth top, bottom, and sidewall surfaces. The corners of the shield are rounded slightly so that the shield can be easily inserted into the partially filled ice cream container with the bottom shield surface being slightly pressed to flatten the exposed surface of the ice cream. The ice cream is thereby partially protected from exposure to the air within the container and thereby deterioration is retarded. A U-shaped chromed wire type handle is pivotably mounted at one end of the top surface of the shield whereby the end user may firmly finger grip the shield for manipulating the shield within the container. In other embodiments of the invention, the shield has a cylindrical or a trapezoidal shape.

17 Claims, 3 Drawing Sheets

ICE CREAM STORAGE SHIELD

BACKGROUND OF THE INVENTION

1. Field of the Invention

The present invention relates generally to an internal storage shield for covering a partially filled food container, and more specifically to an internal transparent shield for covering a partially filled frozen ice cream storage container.

2. Description of the Prior Art

In the field of packaged ice cream, there are many different types of sophisticated packaging devices for preserving the ice cream in the container after the package has been initially opened by the end user. Most edible foods age very quickly when exposed to air. Ice cream begins to especially deteriorate rapidly and is adversely affected after the container is opened. When the partially filled container is refrozen, the air remaining in the container begins the process of the formation of ice crystals, which process changes the taste and the fragrance of the ice cream.

Various solutions to this problem are disclosed in the prior art. One solution is to manually place a cover or lid within the container to cover the remaining contents, which may be food, tobacco, and the like. As shown by the following prior art patents, storage shields for covering the exposed content surface in a partially filled container are broadly well known in the prior art.

U.S. Pat. Nos. 1,145,915, issued Jan. 5, 1965 to Isaac J. Marcuse, 3,164,289 issued to Thomas A. Cocchiarella, 3,784,051 issued Jan. 8, 1974 to James A. C. Shaw, et al., 4,413,747 issued Nov. 8, 1983 to Tyrus N. Tenold, et al., 4,684,042 issued Aug. 4, 1987 to James E. Strickler, et al., 4,723,674 to Morris A. Nunes, and 5,213,230 to Dean Kral disclose the concept of removing some of the contents from a container and placing a shield on the remaining contents to protect the contents.

Many of the prior art lid devices strive to provide completely air tight and sealed containers. Consequently the ice cream is sometimes packaged in a hermetically sealed container. After the seal is broken and restored, a relatively large quantity of air may remain in the partially filled container. Thus, the ice cream commences to age whether or not the seal is restored.

Further, the prior art discloses lid devices that use various types of gaskets on their outer edges for sealing purposes. These prior art devices perform well for dry and liquid products, but are impractical for frozen products. One reason being that the gasketing is in tight contact with the side walls and, as a result, the gasketing will freeze to the side walls. Many times the removal of a lid device from a container will damage the gasketing which is frozen to the side walls of the container or will damage the container itself.

As will be seen, none of the above cited patents, taken alone or in combination, disclose the invention described below and in appended claims.

SUMMARY OF THE INVENTION

A storage shield of this invention is a removable cover for placement on the surface of frozen ice cream remaining in an opened container, thereby partially sealing the surface of the ice cream from remaining air-filled voids. The storage shield, in one embodiment of the invention, is especially adapted for use in a conventional one-half gallon size, box-shaped ice cream carton or package. The shield is made from a transparent synthetic resin material, thus making it possible for the user to see any large remaining air pockets through the shield. The shield, in this embodiment, is a rectangular-shaped planar device with a smooth top, bottom, and sidewall surfaces. The corners of the shield are rounded slightly so that shield can be inserted into the partially filled ice cream container with the bottom shield surface being slightly pressed to flatten the exposed surface of the ice cream. The ice cream is thereby partially protected from exposure to the air within the container and thereby deterioration is retarded. A U-shaped chromed wire type handle is pivotably mounted at one end of the top surface of the shield whereby the user may firmly finger grip the shield for manipulating the shield within the container. In other embodiments of the invention, the shield has a cylindrical or a trapezoidal shape.

It is an object of this invention to provide a new and improved transparent internal storage shield for use by an end user for preserving a frozen ice cream product in a partially-filled container.

It is another object of this invention to provide a reusable shield or lid for placement on the surface of the frozen ice cream remaining in an opened container, thereby partially sealing the ice cream contents from air-filled voids within the container.

It is another object of this invention to provide a simple and inexpensive ice cream storage shield to prevent the remaining ice cream in an opened container from deteriorating in quality.

Other objects, features, and advantages of this invention will become apparent from the following detailed description and the appended claims, reference being had to the accompanying drawing forming a part of the specification, wherein like reference numerals designate corresponding parts of the several views.

DETAILED DESCRIPTION OF THE PREFERRED EMBODIMENT

Figure 2:
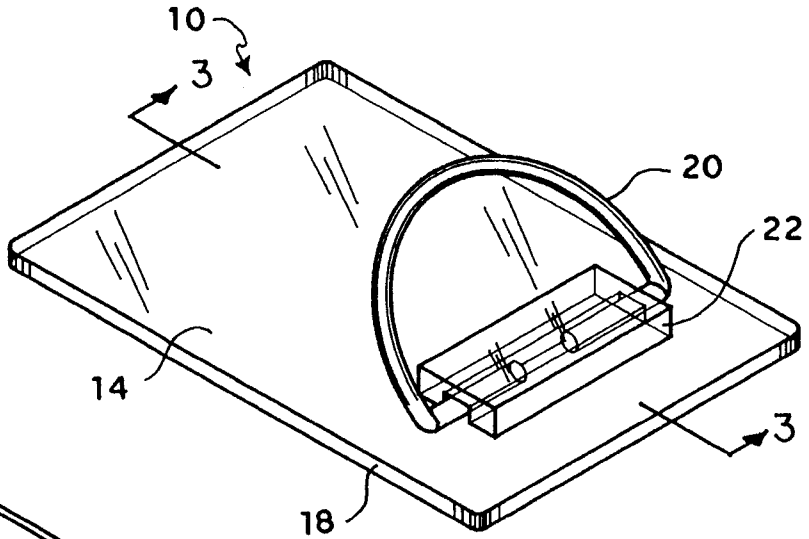
FIG. 2 is a top plan view of the shield of FIG. 1.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limited.

FIGS. 1–4 show a rectangular-shaped shield 10 for use within a partially filled ice cream carton or container 12 having a conventional rectangular box configuration. The conventional carton measures approximately $3\frac{1}{2}$ inches long by $4\frac{3}{4}$ inches wide by $6\frac{3}{4}$ inches in depth. The shield 10 is a reusable cover device that is to be inserted into the six sided container after the end user has removed some of the ice cream. The shield 10 is for the purpose of covering the frozen ice cream remaining in the container 12 and thereby substantially sealing the ice cream from the air-filled void within the container 12. It is to be emphasized that ice cream begins to deteriorate rapidly and is adversely affected after a container is opened. When the partially filled ice cream container 12 is refrozen, the air that remains in the container 12 begins to form ice crystals, and as a result, the taste and fragrance are changed.

Accordingly, the shield 10 acts as a shielding device for protecting the ice cream. The shield 10 is constructed as a rectangular-shaped planar block. The shield block 10 has a smooth top surface 14, a smooth bottom surface 16, and smooth sidewalls 18. The shield 10 is preferably made of a clear or transparent white acrylic or synthetic resin material; for example, "PLEXIGLAS." The dimensions of the shield 10 are considered critical since it is to be inserted into a conventional ice cream box-type carton with substantially fixed dimensions that is sold commercially in today's public market. Each of the top and bottom surfaces 14, 16, has a length and a width, measuring somewhat less than $4\frac{3}{4}$ inches and $3\frac{1}{2}$ inches, respectively so as to leave sufficient undersizing that the lid will fit with-in the carton, and with side walls 18 which are approximately $\frac{1}{8}$ inch in thickness. The corners of the shield 10 are rounded slightly so that the shield 10 can be easily inserted into the partially filled ice cream container 12 with the bottom surface 16 of the shield 10 being pressed slightly against the exposed surface of the ice cream remaining in the container 12. The surface condition of the ice cream is usually in a frozen state, depending on the length of time that the ice cream has been out of the refrigerator. Thus with the use of the shield 10 the frozen ice cream is partially protected from exposure to the air within the container 12 and thereby deterioration is retarded. In the market place, the shield 10 is referred to, under the trade name of "Ice Cream Saver", especially in view of the fact that its ultimate goal is to save the ice cream from deteriorating.

Another important feature of the invention is a substantially U-shaped handle 20 which is pivotably mounted within a small rectangular block 22. The block 22 is permanently fixed to the shield block 10 by suitable and conventional chemically bonding means. The block 22 is offset from the geometrical center of the shield block 10 and is positioned approximately $\frac{1}{2}$ inch from one end of the shield 10 and $3\frac{1}{2}$ inches from the other end, and $\frac{7}{8}$ inches from one edge and $\frac{7}{8}$ inches from the opposite edge. The block 22 measures 1 and $\frac{3}{4}$ inches long, $\frac{3}{4}$ inches wide, and $\frac{3}{8}$ inches thick. The block 22 has a square groove cut into its bottom surface. The groove measures $1\frac{3}{4}$ inches long by $\frac{1}{8}$ inches wide by $\frac{1}{8}$ inches deep. The grooved side of this portion of the block 22 holds the handle 20. The handle 20 is made from a $\frac{1}{8}$ inch thick solid heavy duty wire, which may be stainless steel. The wire handle 20 is preferably plated with chromium. The hardness is medium hard and has a half-round or "D" shape. The handle 20 measures $2\frac{1}{4}$ inches long (outside diameter) by $1\frac{1}{4}$ inches wide (outside diameter). The handle 20 is placed in the $\frac{1}{8}$ inch by $\frac{1}{8}$ inch groove before it is chemically bonded to one side of the shield body 10. The block 22 is also made of "PLEXIGLAS."

Figure 1:
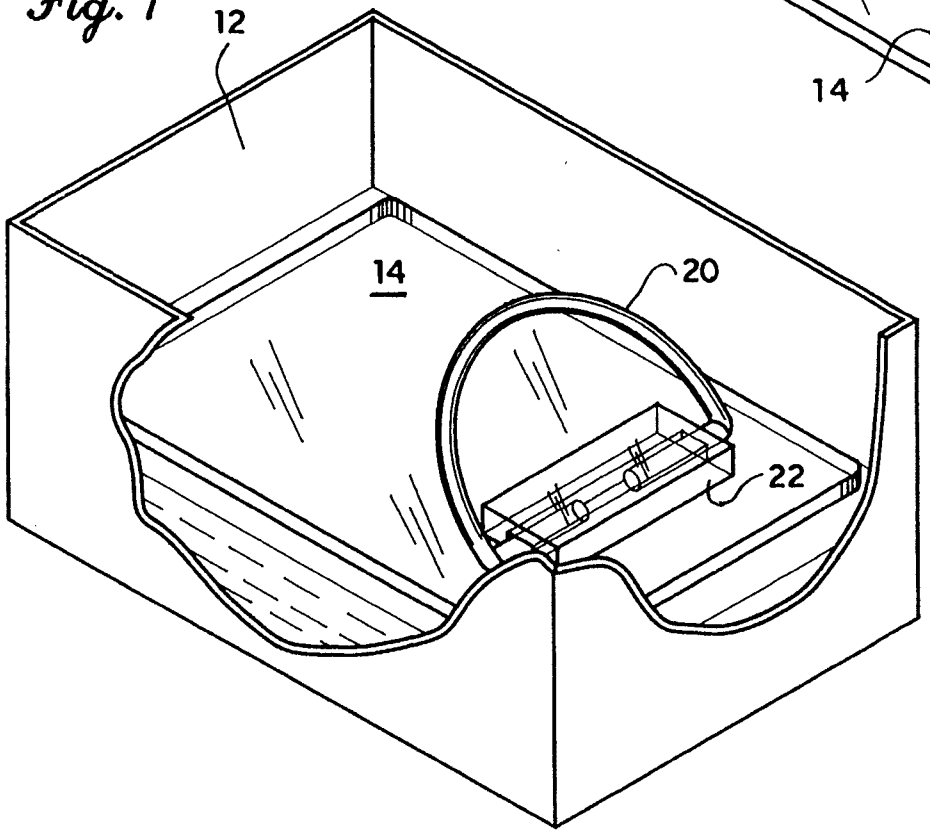
FIG. 1 is a perspective view of the shield inserted within a partially filled ice cream container, with a portion of the container side wall partially broken away to show the shield covering the ice cream.
Figure 3:
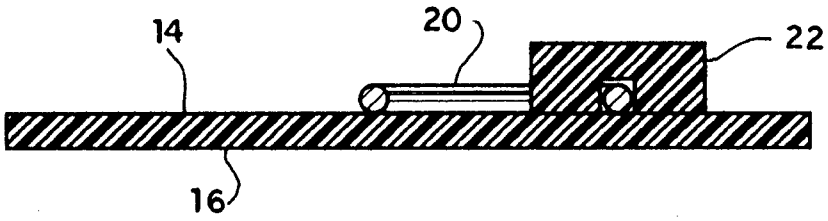
FIG. 3 is a cross-sectional view of the shield taken along line 3—3 of FIG. 2.
Figure 4:
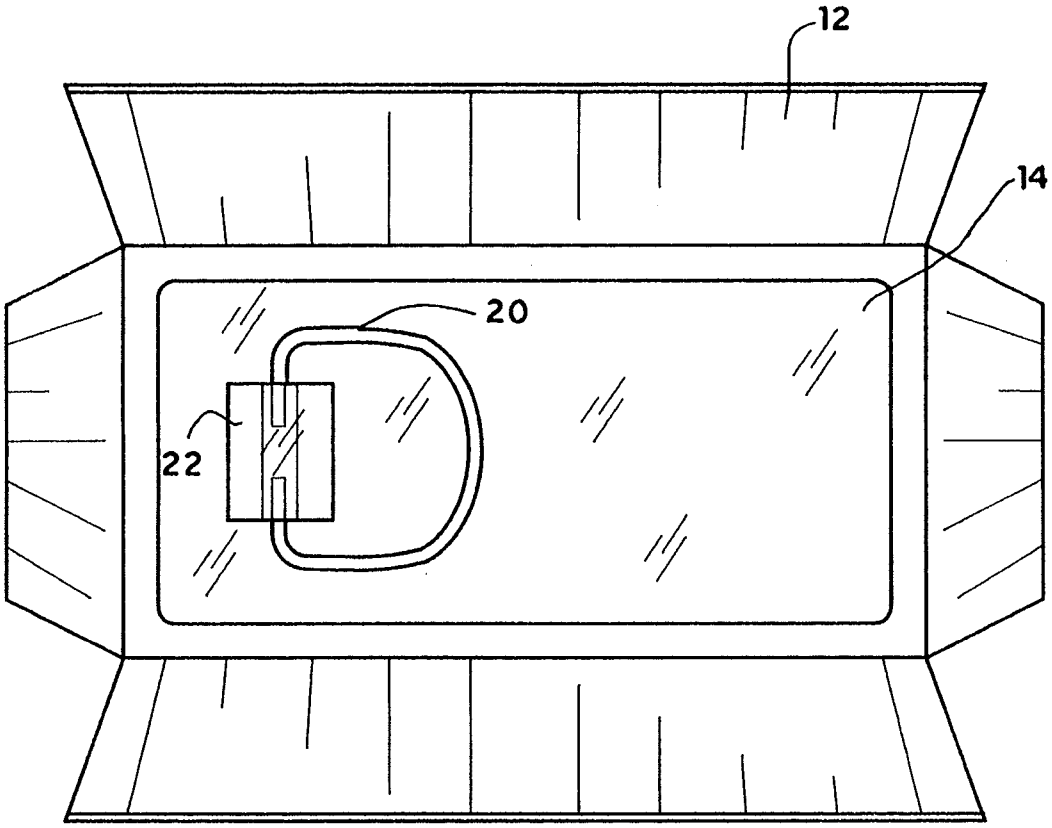
FIG. 4 is a top view of the shield positioned on the surface of the ice cream, showing the flaps of the partially filled container .

As illustrated in FIG. 1, two fingers of the end user of the ice cream product are curled under the U-shaped wire handle 20 for manipulating (pushing or pulling) the shield 10. Some of the manipulative steps are: firstly, the end user inserts two fingers under the handle 20 and with a pulling action, removes the shield 10 from the container 12 when the end user desires a quantity of ice cream; and secondly, after removal of a quantity of ice cream from the container 12, the end user curls two fingers under the U-shaped handle 20 whereby the shield 10 in a pushing action slightly contacts the surface of the frozen ice cream to smooth the surface somewhat.

Figure 5:
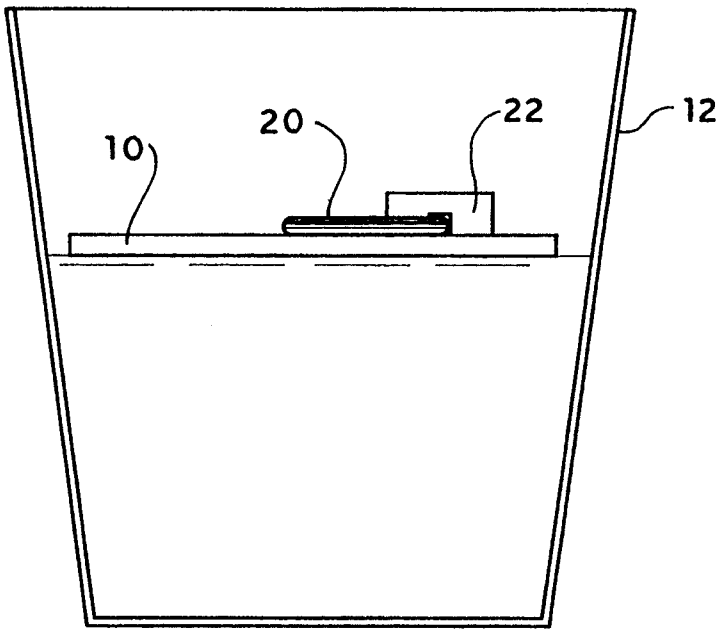
FIG. 5 is a perspective view of a cylindrically-shaped shield in accordance with a second embodiment of the invention.
Figure 6:
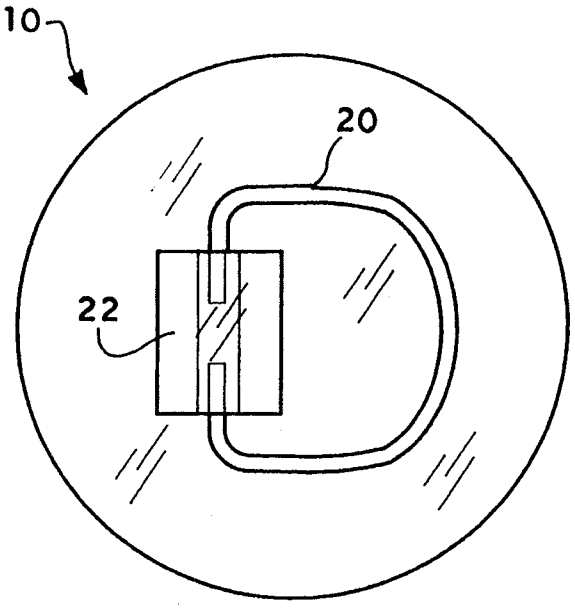
FIG. 6 is a perspective view of a shield positioned within a trapezoidal-shaped container in accordance with a third embodiment of the invention.

Referring to FIG. 5, a second embodiment of the storage shield device 10 is disclosed in which the storage shield device 10 has a cylindrically-shaped configuration for operatively associating with a cylindrically-shaped container as described above. In FIG. 6, a third embodiment of the storage device 10 may have a planar shape of a square, rectangle, or circular for inserting within a suitably shaped trapezoidal-shaped container.

The end user is well aware of the fact that ice cream is packaged in various shaped containers, largely depending on the quantity of the ice cream to be packaged. Many of these containers are box-shaped, cylindrically-shaped, and the like. Thus, it follows that a storage shield device could be constructed in any desired shape to fit a particular shaped container. Further, since it is common for the end user to have a series of articles, like a series of measuring spoons of different capacities, it is within the realm of this invention, to construct a series of storage shields of different configurations and different sizes to fit within many of the commercially available ice cream containers; such a plurality of shields could be connected together in the same way that the measuring spoons are.

While it will be apparent that the preferred embodiment of the invention herein disclosed is well calculated to fulfill the objects above-stated, it will be appreciated that the invention is susceptible to modifications, variations, and changes without departing from the proper scope or fair meaning of the subjoined claims. For example, the shield devices have been described herein in association with an ice cream product; however, it is obvious that the structural shield arrangements disclosed herein may be used in conjunction with products other than ice cream.

What is claimed is:

1. A storage shield device for covering an exposed surface of a food product positioned within a partially filled food container comprising:

a planar element adapted for insertion and removal within the partially filled food container; said planar element configured so a surface of said planar element presses against a food product within the partially filled food container; said planar element including a periphery, and means for providing substantial protection for an exposed surface of the food product from exposure to air within the partially filled food container and thereby retarding the deterioration of the food product; and a handle;

a hinge pivotally connecting said handle to said planar element and located in a position offset from a geometrical center of a top surface of said planar element for facilitating insertion and removal of said storage shield device to and from the partially filled food container, said hinge allowing said handle to alternately occupy a first position and a second position;

wherein said handle is within said periphery when said handle is in said first position, and wherein said handle is sized such that a portion of said handle extends beyond said periphery of said planar element when said handle is in said second position.

2. A storage shield device according to claim 1, wherein said planar element has a rectangular-box-shaped configuration.

3. A storage shield device according to claim 2, wherein a length and a width of said top and bottom surfaces are approximately four and three-quarters inches and three and one-half inches, respectively, and a thickness of said sidewall structure is approximately one-eighth inch.

4. A storage shield device according to claim 1, wherein said planar element has a cylindrical-shaped configuration.

5. A storage shield device according to claim 1, wherein said planar element has a square-box-shaped configuration.

6. A storage shield device according to claim 1 wherein said planar element is made of a transparent synthetic resin material which provides visibility for a user to view the condition of the food product, when said storage shield device is in use.

7. A storage shield device according to claim 1, further comprising:

a block mounted on said top surface of said planar element;

said handle includes a substantially U-shaped wire wherein the ends of the substantially U-shape wire being mounted within said block; said substantially U-shaped wire providing for finger grip of said planar element by the end user.

8. A storage shield device according to claim 7, wherein said block has a rectangular-shaped configuration.

9. A storage shield device according to claim 7, wherein said block is made of a transparent synthetic resin material.

10. A storage shield for covering an exposed surface of ice cream in a partially filled ice cream container having a cover comprising:

a planar element adapted for insertion and removal within the partially filled ice cream container;

said planar element having smooth top and bottom surfaces connected by a sidewall structure defining a periphery and said bottom surface being pressed against the exposed ice cream;

said planar element providing substantial protection for the exposed surface of the ice cream from exposure to air within the partially filled ice cream container and thereby retarding the deterioration of the ice cream;

a block mounted on said top surface of said planar element; and a handle pivotably mounted through said block and positioned at one end of said top surface for providing a readily accessible structural arrangement for the operation of insertion and removal of said planar element to and from the partially filled ice cream container by an end user, wherein said block allows said handle to pivotally occupy a first position and a second position;

wherein said handle is within said periphery when said handle is in said first position, and wherein said handle is sized so that a portion of said handle extends beyond said periphery of said planar element when said handle is in said second position.

11. A storage shield device according to claim 10, wherein said planar element has a rectangular-box-shaped configuration.

12. A storage shield device according to claim 11, wherein a length and a width of said top and bottom surfaces of said rectangular-box-shaped planar element are approximately four and three-quarters inches and three and one-half inches, respectively, and the thickness of said sidewall structure is approximately one-eighth inch.

13. A storage shield device according to claim 10, wherein said planar element has a cylindrical-shaped configuration.

14. A storage shield device according to claim 10, wherein said planar element has a square-box-shaped configuration.

15. A storage shield device according to claim 10, wherein said planar element and said block are made of a transparent synthetic resin material which provides visibility for the end user to inspect the condition of the exposed surface of the exposed ice cream.

16. A storage shield device according to claim 10, wherein said handle further comprises a substantially U-shaped wire wherein the ends of the substantially U-shape being mounted within said block;

said substantially U-shaped wire providing for firm and sturdy finger grip of said planar element by the end user.

17. In combination a storage shield for partially covering an exposed surface of ice cream and a partially filled ice cream container comprising:

a storage shield including a planar element defining a periphery and adapted for insertion and removal within the partially filled ice cream container;

a partially filled container including container walls and containing ice cream;

wherein a bottom surface of said planar element is operatively pressed against a top surface of the ice cream during insertion within the partially filled container;

a hinge eccentrically mounted on a top surface of said planar element;

a handle pivotally connected to said hinge so that said handle alternately occupies a first position and a second position, wherein said handle is within said periphery when said handle is in said first position, and said handle is sized so that a portion of said handle extends beyond said periphery of said planar element when said handle is in said second position;

said planar element configured so a gap is defined between the periphery of said planar element and said container walls so the top surface of the ice cream is substantially protected from exposure to air within the partially filled ice cream container and thereby retarding the deterioration of the ice cream.

* * * * *